US008036567B2

(12) United States Patent
Hayakawa

(10) Patent No.: US 8,036,567 B2
(45) Date of Patent: Oct. 11, 2011

(54) IMAGE FORMING APPARATUS

(75) Inventor: Atsushi Hayakawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 418 days.

(21) Appl. No.: 12/372,771

(22) Filed: Feb. 18, 2009

(65) Prior Publication Data

US 2009/0208242 A1 Aug. 20, 2009

(30) Foreign Application Priority Data

Feb. 19, 2008 (JP) ..... 2008-037391

(51) Int. Cl.
*G03G 15/16* (2006.01)
*G03G 15/20* (2006.01)

(52) U.S. Cl. ..... 399/101; 399/312

(58) Field of Classification Search ..... 399/101, 399/312, 388
See application file for complete search history.

(56) References Cited

U.S. PATENT DOCUMENTS

| | | | | |
|---|---|---|---|---|
| 5,956,152 | A | 9/1999 | Yamada et al. | |
| 7,720,407 | B2 * | 5/2010 | Okamoto et al. | 399/101 |
| 7,869,105 | B2 * | 1/2011 | Ikeda | 358/498 |
| 7,912,417 | B2 * | 3/2011 | Yoshida | 399/388 |
| 2007/0009284 | A1 | 1/2007 | Okamoto et al. | |
| 2007/0053719 | A1 * | 3/2007 | Kamimura et al. | 399/167 |

FOREIGN PATENT DOCUMENTS

| | | | |
|---|---|---|---|
| JP | 6-018342 | A | 3/1994 |
| JP | 8-143177 | A | 6/1996 |
| JP | 8-152054 | A | 6/1996 |
| JP | 9-307702 | A | 11/1997 |
| JP | 2001-083753 | A | 3/2001 |
| JP | 2003-107823 | A | 4/2003 |
| JP | 2007-010838 | A | 1/2007 |
| JP | 2007-072021 | A | 3/2007 |

OTHER PUBLICATIONS

JP Office Action dtd Nov. 24, 2009, JP Appln. 2008-037391, English translation.

* cited by examiner

*Primary Examiner* — David Gray
*Assistant Examiner* — Frederick Wenderoth
(74) *Attorney, Agent, or Firm* — Banner & Witcoff, Ltd

(57) ABSTRACT

An image forming apparatus includes an endless belt that is rotated, an image forming device configured to form an image on a recording medium which fed on the endless belt, a cleaning roller configured to be rotated and clean the endless belt, a pair of registration rollers configured to be rotated in a recording medium feeding direction and to feed a recording medium to the image forming device, and a motor configured to rotate in two directions. The image forming apparatus may further include first, second, and third gear mechanisms. The first and second gear mechanisms are configured to switch between transmission and non-transmission of a driving force to the cleaning roller according to rotational direction of the motor. The third gear mechanism is configured to switch between transmission and non-transmission of the driving force to the registration roller according to the rotational direction of the motor.

10 Claims, 8 Drawing Sheets

IMAGE FORMING APPARATUS

CROSS REFERENCE TO RELATED APPLICATION

This application claims priority from Japanese Patent Application No. 2008-037391, filed on Feb. 19, 2008, the entire subject matter of which is incorporated herein by reference.

FIELD

Aspects of the invention relate to an image forming apparatus configured to form an image on a recording medium using an endless belt to be driven to rotate, more specifically to an image forming apparatus having a cleaning roller which is configured to clean the endless belt and registration rollers which are configured to feed the recording medium inserted into the apparatus by a user toward an image formation unit.

BACKGROUND

It has been proposed that various types of image forming apparatuses be provided with an image formation unit configured to form an image on a recording medium using a rotating endless belt. This type of image forming apparatus has been proposed to include a cleaning roller that is configured to rotate in a predetermined direction for cleaning the endless belt or registration rollers that are configured to rotate to feed the recording medium toward the image formation unit when the recording medium is inserted manually. If the image forming apparatus is provided with the cleaning roller, the endless belt soiled during image formation can be cleaned. If the image forming apparatus is provided with the registration rollers, the image formation can be performed on a sheet manually inserted by the user.

When the image forming apparatus is provided with the registration rollers and the cleaning roller, it is proposed that the registration rollers and the cleaning rollers be driven by the same motor, and a clutch, which is configured to switch between transmission and non-transmission of driving force, be disposed on a path connecting to the registration rollers.

A general clutch having a solenoid may be used to switch between the transmission and non-transmission of driving force to the registration rollers. In this case, power should be continuously applied to the solenoid of the clutch for a long time in order to drive the cleaning roller while stopping the registration rollers during, for example, auto registration adjustment for color matching. Thus, the clutch should include a large-sized solenoid that can endure long-duration power application.

SUMMARY

Aspects of the invention provide an image forming apparatus having a motor that drives registration rollers and a cleaning roller, which is configured to perform an operation to drive both the registration rollers and the cleaning roller simultaneously and an operation to drive the cleaning roller only, without using a clutch and a solenoid to control the clutch.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. An image forming apparatus according to aspects of the invention applies is shown in FIG. 1.

For ease of discussion, in the following description, the top or upper side, the bottom or lower side, the left or left side, the right or right side, the front or front side, and the rear or rear side are used to define the various parts when the image forming apparatus 1 is disposed in an orientation in which it is intended to be used. In FIG. 1, the right side is referred to as the front or front side, the left side is referred to as the rear or the rear side, the up side is referred to as the top or upper side, and the down side is referred to as the bottom or lower side.

A general structure of the image forming apparatus 1 will be described.

Figure 1:
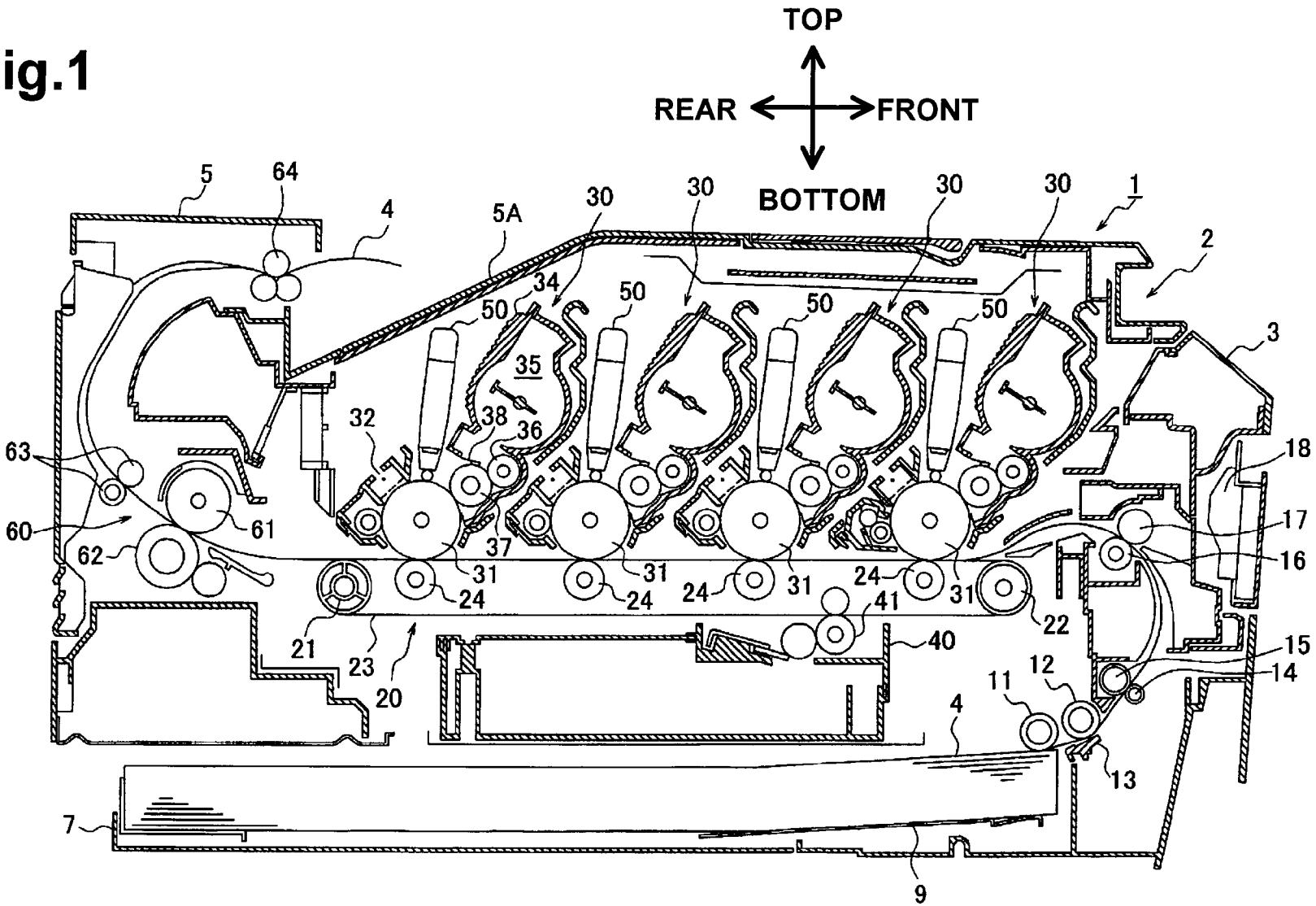
FIG. 1 is a side sectional view of an internal structure of an image forming apparatus according to illustrative aspects using features described herein.

As shown in FIG. 1, the image forming apparatus 1 is a color printer of direct transfer tandem type, and may include a generally box-shaped main body 2. A front surface of the main body 2 contains a front cover 3. A top surface of the main body 2 contains an output tray 5A on which a recording medium, e.g. a recording sheet 4 having an image thereon can be placed. The top surface of the main body 2 further contains a top cover 5 integrally formed with the output tray 5A. The top cover 5 is mounted at a rear upper end of the image forming apparatus 1.

A sheet supply tray 7 may be disposed in a lower portion of the main body 2 and configured to load a stack of sheets 4 therein. The sheet supply tray 7 may be configured to be attached to and removed from the front of the main body 2. The sheet supply tray 7 includes a pressing plate 9 as an example of a support plate inclinable to raise the front end of the stack of sheets 4. A pickup roller 11 to pick up sheets 4 is disposed in a front upper portion of the sheet supply tray 7. A separation roller 12 and a separation pad 13 are disposed on a downstream side of the pickup roller 11 in a direction where a sheet 4 is conveyed (hereinafter referred to as a sheet conveying direction). The separation roller 12 and the separation pad 13 are configured to separate the sheets 4 picked up by the pickup roller 11 one by one.

An uppermost sheet 4 in the sheet supply tray 7 is separated by the separation roller 12, sandwiched between a dust removing roller 14 and a roller 15 and conveyed between a pair of registration rollers 16, 17. The registration rollers 16, 17 convey the sheet 4 onto the belt unit 20 at a specified timing. Part of the front cover 3 is configured to open as a manual feed tray 18. The user can directly insert a sheet 4 between the registration rollers 16, 17 from the manual feed tray 18. A sheet 4 inserted through the manual feed tray 18 can be conveyed onto the belt unit 20.

The belt unit 20 is configured to be attached to and removed from the main body 2. The belt unit 20 includes a belt drive roller 21, a tension roller 22 spaced apart in the front-rear direction, and an endless belt, e.g. a conveyor belt 23, horizontally extended between and looped around the belt drive unit 21 and the tension roller 22. The conveyor belt 23 is made from resin such as polycarbonate. When the belt drive roller 21 is driven and rotated, the conveyor belt 23 rotates clockwise in FIG. 1 to convey the sheet 4 thereon rearward.

Inside the conveyor belt 23, four transfer rollers 24 are spaced apart at regular intervals in the front-rear direction. The transfer rollers 24 are disposed facing respective photosensitive drums 31 of image formation units 30 via the conveyor belt 23. In other words, the conveyor belt 23 is sandwiched between the transfer rollers 24 and the corresponding photosensitive drums 31. During toner image transfer, a bias is applied to between the transfer rollers 24 and the photosensitive drums 31, and a specified amount of current is passed therebetween. A known belt cleaner 40 is disposed below the belt unit 20. The belt cleaner 40 includes a cleaning roller 41 that is configured to remove dust or sheet powder adhering to the conveyor belt 23. The cleaning roller 41 is disposed in contact with the conveyor belt 23 and configured to rotate in a predetermined direction (counterclockwise in FIG. 1) opposite from the rotation direction of the conveyor belt 23.

The image forming apparatus 1 includes four image formation units 30 paired with LED units 50. The image formation units 30 are provided for four colors of black, cyan, magenta, and yellow. The image formation units 30 and the LED units 50 are arranged in line along the sheet conveying direction. The image formation units 30, the LED units 50, and the belt unit 20 function as an image formation device.

Each image formation unit 30 includes an image carrier, e.g. the photosensitive drum 31, a scorotron charger 32, and a developing device, e.g. a developing cartridge 34. The photosensitive drum 31 includes a grounded metal drum body and a positively chargeable photosensitive layer formed of polycarbonate coating the drum body. The scorotron charger 32 is disposed diagonally above and away from the corresponding photosensitive drum 31 so as to face it. The scorotron charger 32 is configured to generate a corona discharge from a charging wire made of such as tungsten and cause the surface of the photosensitive drum 31 to become positively charged uniformly.

The developing cartridge 34 is generally box-shaped, and includes a toner chamber 35 in an upper portion inside and a supply roller 36, a developing roller 37 and a layer-thickness regulating blade 38 under the toner chamber 35. Each toner chamber 35 accommodates a developer, e.g. nonmagnetic one-component toner which is to be positively charged of black, cyan, magenta, or yellow.

Toner discharged from the toner chamber 35 is supplied to the developing roller 37 along with rotation of the supply roller 36, and positively charged between the supply roller 36 and the developing roller 37 by friction. The toner supplied onto the developing roller 37 goes in between the layer-thickness regulating blade 38 and the developing roller 37 along with the rotation of the developing roller 37, and is sufficiently charged by friction therebetween, and carried on the developing roller 37 as a thin layer having a constant thickness.

The surface of the photosensitive drum 31 may be uniformly and positively charged by the scorotron charger 32, and exposed to light emitted from a row of LEDs (not shown) arranged at a lower end of the LED unit 50 across the width of a sheet or in the left-right direction of the image forming apparatus 1, and an electrostatic latent image is formed based on the image to be formed on the sheet 4.

When the developing roller 37 rotates, positively charged toner carried on the developing roller 37 is supplied to the electrostatic latent image formed on the surface of the photosensitive drum 31. Thus, the latent image on the photosensitive drum 31 becomes visible, and a toner image, in which toner is adhered to an exposed area only is carried on the photosensitive drum 31.

While the sheet 4 is conveyed on the conveyor belt 23 and passes between each photosensitive drum 31 and its corresponding transfer roller 24, the toner image carried on the surface of each photosensitive drum 31 is successively transferred onto the sheet 4 by the transfer current. The sheet 4 to which four-color toner images have been transferred in this manner is conveyed to a fixing unit 60.

The fixing unit 60 is disposed at the rear of the conveyor belt 23 in the main body 2. The fixing unit 60 includes a heat roller 61 and a pressure roller 62. The heat roller 61 has a heat source such as a halogen lamp and is configured to be driven and rotated. The pressure roller 62 is disposed facing the heat roller 61 so as to press the heat roller 61 from below and configured to be rotated along with the rotation of the heat roller 61. In the fixing unit 60, the sheet 4 having the four-color toner images thereon is heated while it is conveyed between the heat roller 61 and the pressure roller 62, and the toner images are thermally fixed onto the sheet 4. The sheet 4 on which the toner images have been thermally fixed is conveyed between conveying rollers 63, which are disposed diagonally above the fixing unit 60. The sheet 4 is further conveyed between ejection rollers 64 disposed in the upper portion of the main body 2, and is finally ejected to the output tray 5A.

Figure 2:
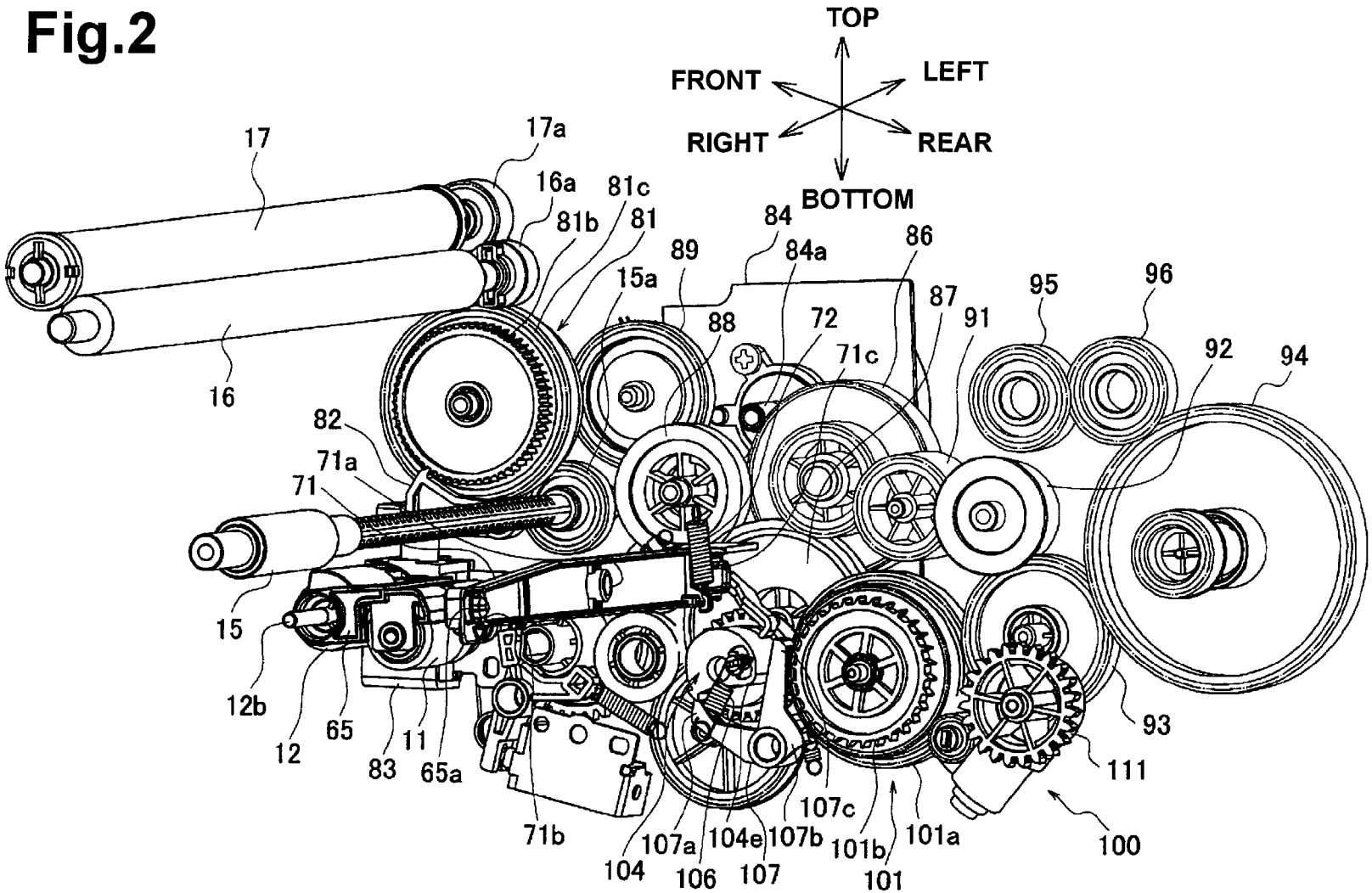
FIG. 2 is a perspective view of roller drive systems of the image forming apparatus shown from rear right side.

Drive systems for rollers will be described with reference to FIGS. 2-4. As shown in FIG. 2, the pickup roller 11 and the separation roller 12 are rotatably supported by a holder 65. The holder 65 includes a pickup roller gear, which integrally rotates with the pickup roller 11, a separation roller gear, which integrally rotates with the separation roller 12, and an idle gear, which connects the pickup roller 11 and the separation roller 12, which are not shown. Thus, the pickup roller gear, the separation roller gear, and the idle gear are engaged with each other, so that the pickup roller 11 and the separation roller 12 are coupled to rotate in the same direction. A driving force to enable the pickup roller 11 and the separation roller 12 to rotate is transmitted through a separation roller shaft 12*b* that is configured to rotate integrally with the separation roller 12 and the separation roller gear.

The holder 65 is disposed pivotally on the separation roller shaft 12*b* in response to movement of a lift arm 71. The lift arm 71 is supported by the holder 65 so as to pivot on its fulcrum point 71*a* located generally centrally. The lift arm 71 is provided with, on the right end, an engagement hole 71*b*. The engagement hole 71*b* is engaged with a protrusion 65*a* of the holder 65, which is provided on a side close to the pickup roller 11. A left end 71*c* of the lift arm 71 is urged upward by an extension coil spring 72. By the urging force and the weight of the pickup roller 11, the lift arm 71 is urged counterclockwise in FIG. 2 on the fulcrum point 71*a*, so that its right end rotates downward.

The registration rollers 16, 17 are provided with registration roller gears 16*a*, 17*a* respectively at one end, e.g. the left end in FIG. 2. The registration roller gears 16*a*, 17*a* are arranged in engagement with each other, so that the registration rollers 16, 17 rotate in the same direction and at the same speed at a nip between the registration rollers 16, 17. The upper registration roller gear 17*a* is arranged to engage with an idle gear 19*a* (FIG. 3), which engages the rim of a carrier 81*c* (FIG. 3) of a clutch gear 81 as an example of a clutch mechanism. A ring gear 81*a* (FIG. 3) of the clutch gear 81 is formed with internal teeth (not shown) on the inner surface. A plurality of planetary gears (not shown) is disposed between a sun gear (not shown) rotating integrally with a sun gear 81*b* and the internal teeth of the ring gear 81*a*. The planetary gears are supported by the carrier 81*c* having teeth on the rim.

Thus, when a first hook 82 is engaged with the sun gear 81*b* to stop the sun gear 81*b* rotating, a driving force transmitted to the ring gear 81*a* is transmitted to the carrier 81*c*, and the driving force transmitted to the carrier 81*c* is transmitted via the idle gear 19*a* to the registration rollers 16, 17. Conversely, when the first hook 82 is disengaged from the sun gear 81*b* to cause the sun gear 81*b* to rotate freely, even if the ring gear 81*a* is caused to rotate, the sun gear 81*b* rotates idle and the carrier 81*c* does not rotate.

Figure 3:
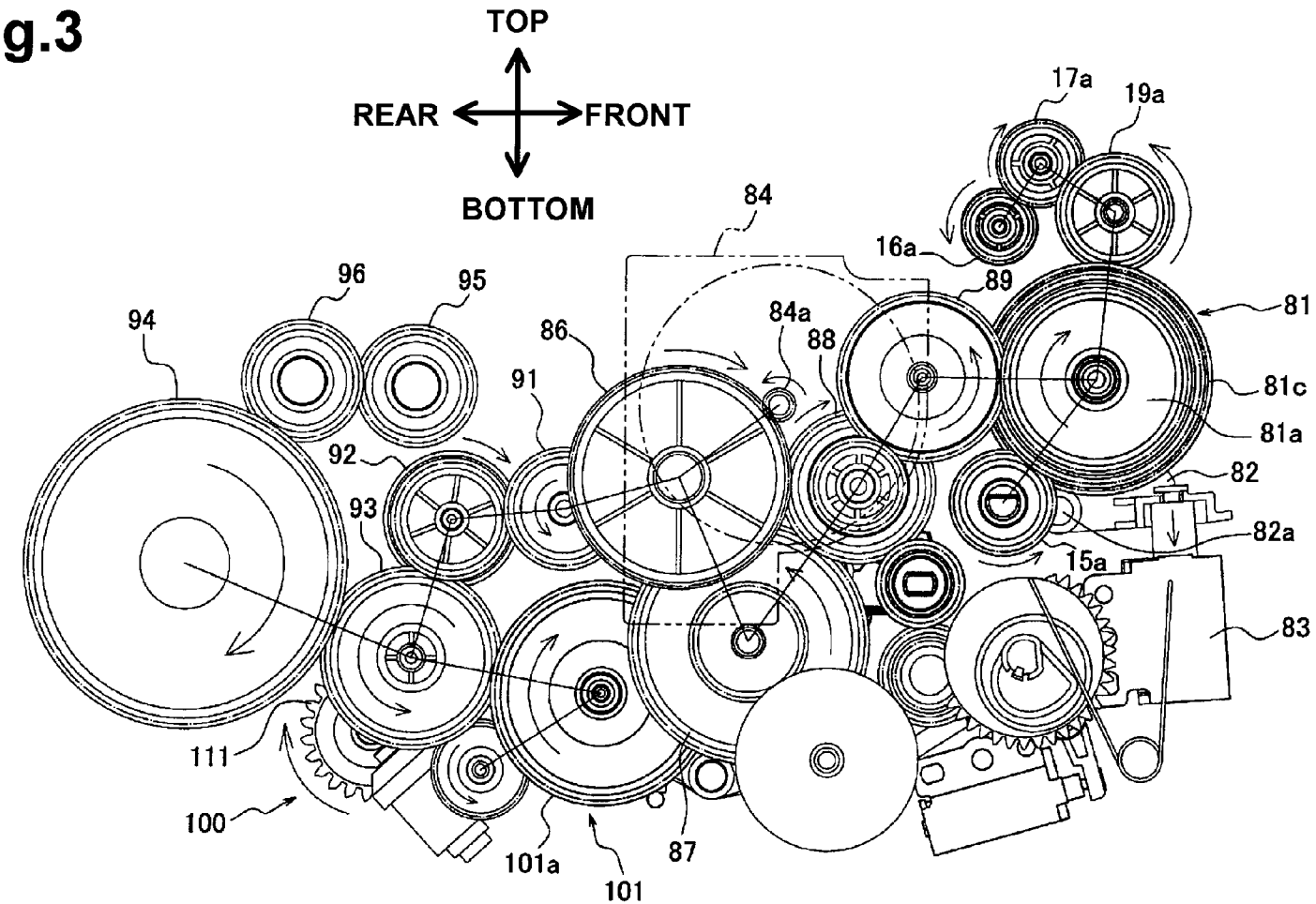
FIG. 3 is a left side view of the roller drive systems when a motor rotates in the normal direction.

As shown in FIG. 3, a solenoid 83 is disposed under the first hook 82. The solenoid 83 is configured to cause the first hook 82 to pivot on a shaft 82*a*. When the solenoid 83 is not supplied with current, it moves the first hook 82 upward to engage it with the sun gear 81*b*. When the solenoid 83 is supplied with current, it moves the first hook 82 downward to release engagement with the sun gear 81*b*.

When a driving gear 84*a*, which is fixed to a rotation shaft of a motor 84, rotates in a first direction (hereinafter referred to as a normal direction in this embodiment; counterclockwise in FIG. 3), a driving force is transmitted to the ring gear 81*a* of the clutch gear 81 as follows. As shown in FIGS. 2 and 3, the rotation of the driving gear 84*a* is transmitted to a pendulum gear 89 by way of speed-reduction gears 86, 87, 88, which have respective large diameter portions and small diameter portions. The pendulum gear 89 is a known pendulum gear that is disposed pivotally on a rotation shaft of the speed-reduction gear 88 while keeping engagement with the speed-reduction gear 88. While the driving gear 84*a* rotates in the normal direction, the pendulum gear 89 moves to the right in FIG. 3 to engage the ring gear 81*a*.

When the motor 84 rotates in the normal direction, it can rotate the ring gear 81*a* clockwise in FIG. 3 via a gear train or gear mechanism made up of the speed-reduction gears 86, 87, 88 and the pendulum gear 89. At this time, if the solenoid 83 is not supplied with current, the first hook 82 engages the sun gear 81*b* so that the registration rollers 16, 17 can rotate. When the solenoid 83 is supplied with current, the sun gear 81*b* is idle and the registration rollers 16, 17 are stopped. The ring gear 81*a* also engages the roller gear 15*a* that rotates integrally with the roller 15. When the motor 84 rotates in the normal direction, the roller 15 is driven and rotated in the sheet conveying direction. In FIGS. 3 and 4, solid lines represent paths where driving force is transmitted.

Figure 4:
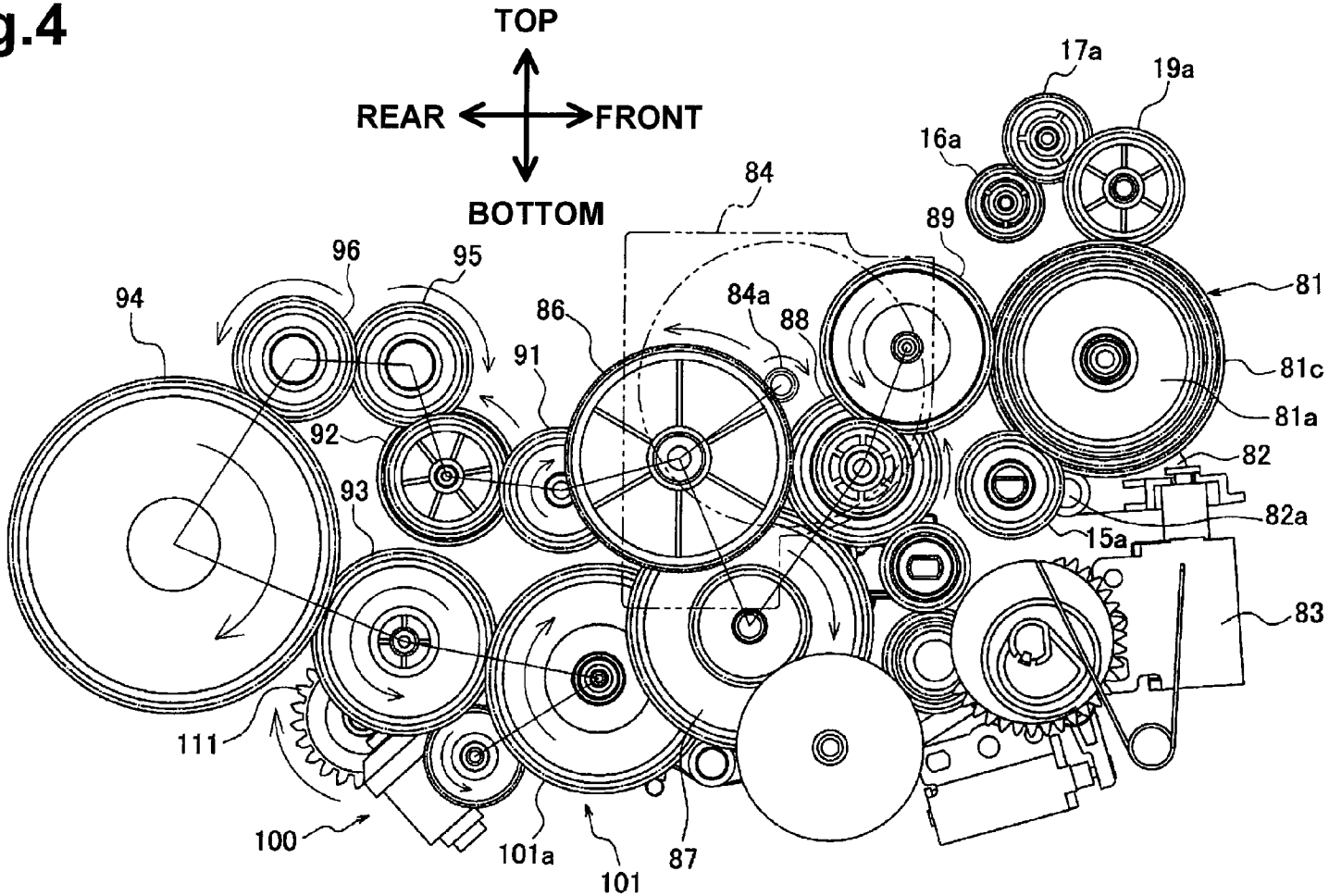
FIG. 4 is a left side view of the roller drive systems when the motor rotates in the normal direction.

When the driving gear 84*a*, which is fixed to the rotation shaft of the motor 84, rotates in a second direction (hereinafter referred to as a reverse direction in this embodiment; clockwise in FIG. 4), the pendulum gear 89 moves to the left as shown in FIG. 4 and disengages from the ring gear 81*a*. Thus, any driving force is not transmitted to the registration rollers 16, 17, and the registration rollers 16, 17 can be kept stationary, regardless of the state of the solenoid 83.

As shown in FIGS. 2 and 3, the driving gear 84*a* engages with the speed-reduction gear 86, the speed-reduction gear 86 engages with an idle gear 91, and the idle gear 91 engages with a pendulum gear 92. The pendulum gear 92 is a known pendulum gear that is disposed pivotally on a rotation shaft of the idle gear 91 while keeping engagement with the idle gear 91. While the driving gear 84*a* rotates in the normal direction, the pendulum gear 92 moves downward, disengages from an idle gear 95, and engages with an idle gear 93 as shown in FIG. 3. The idle gear 93 engages with a cleaner driving gear 94 via a plurality of idle gears (not shown). The cleaner driving gear 94 is configured to drive the cleaning roller 41. When the motor 84 rotates in the normal direction, it can rotate the cleaner driving gear 94 clockwise in FIG. 3 via a gear train or gear mechanism made up of the speed-reduction gear 86, the idle gear 91, the pendulum gear 92, and the idle gear 93 so that the cleaning roller 41 can be rotated in the predetermined direction.

When the driving gear 84*a* rotates in the reverse direction, the pendulum gear 92 moves upward, disengages from the idle gear 93, and engages with the idle gear 95 as shown in FIG. 4. The idle gear 95 engages with an idle gear 96, which engages with the cleaner driving gear 94. Thus, even when the motor 84 rotates in the reverse direction, it can rotate the cleaner driving gear 94 clockwise in FIG. 4 via a gear train or gear mechanism made up of the speed-reduction 86, the idle gear 91, the pendulum gear 92, the idle gear 95, and the idle gear 96 so that the cleaning roller 41 can be rotated in the predetermined direction.

The idle gear 93 engages with a ring gear 101*a* that is part of a clutch gear 101 configured in the same manner as the clutch gear 81. The ring gear 101*a* is configured to apply a driving force to a pressing plate lifting mechanism 100 that is configured to raise the pressing plate 9 as number of sheets in the stack of sheets 4 decreases. The ring gear 101*a* engages with the idle gear 93 that engages with the cleaner driving gear 94, so that it is rotated clockwise in FIGS. 3 and 4 even when the motor 84 rotates in the normal direction and the reverse direction.

The configuration of the pressing plate lifting mechanism 100 will be described with reference to FIGS. 5-8.

Figure 5:
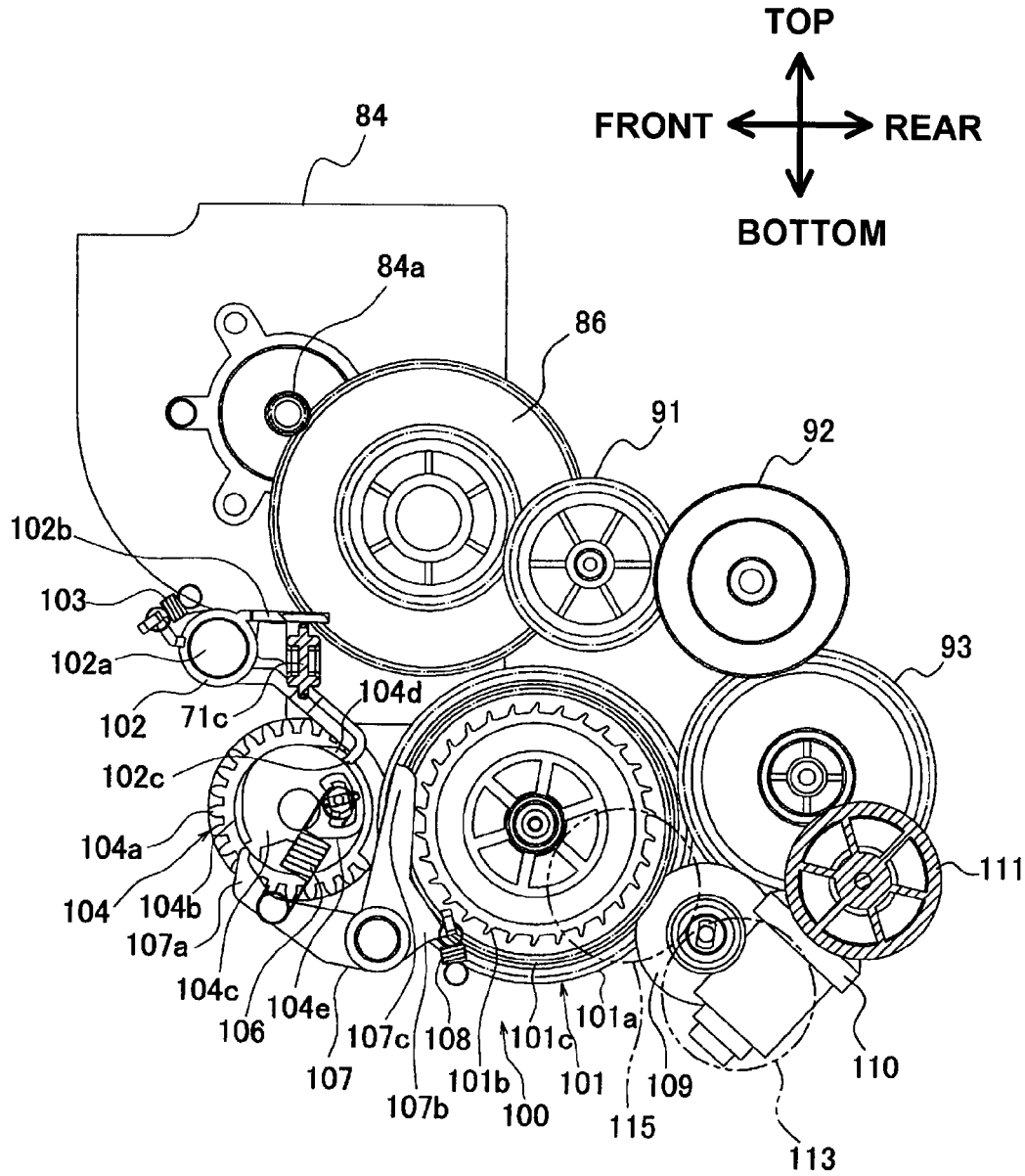
FIG. 5 is a cross sectional view of a pressing plate lifting mechanism.
Figure 6:
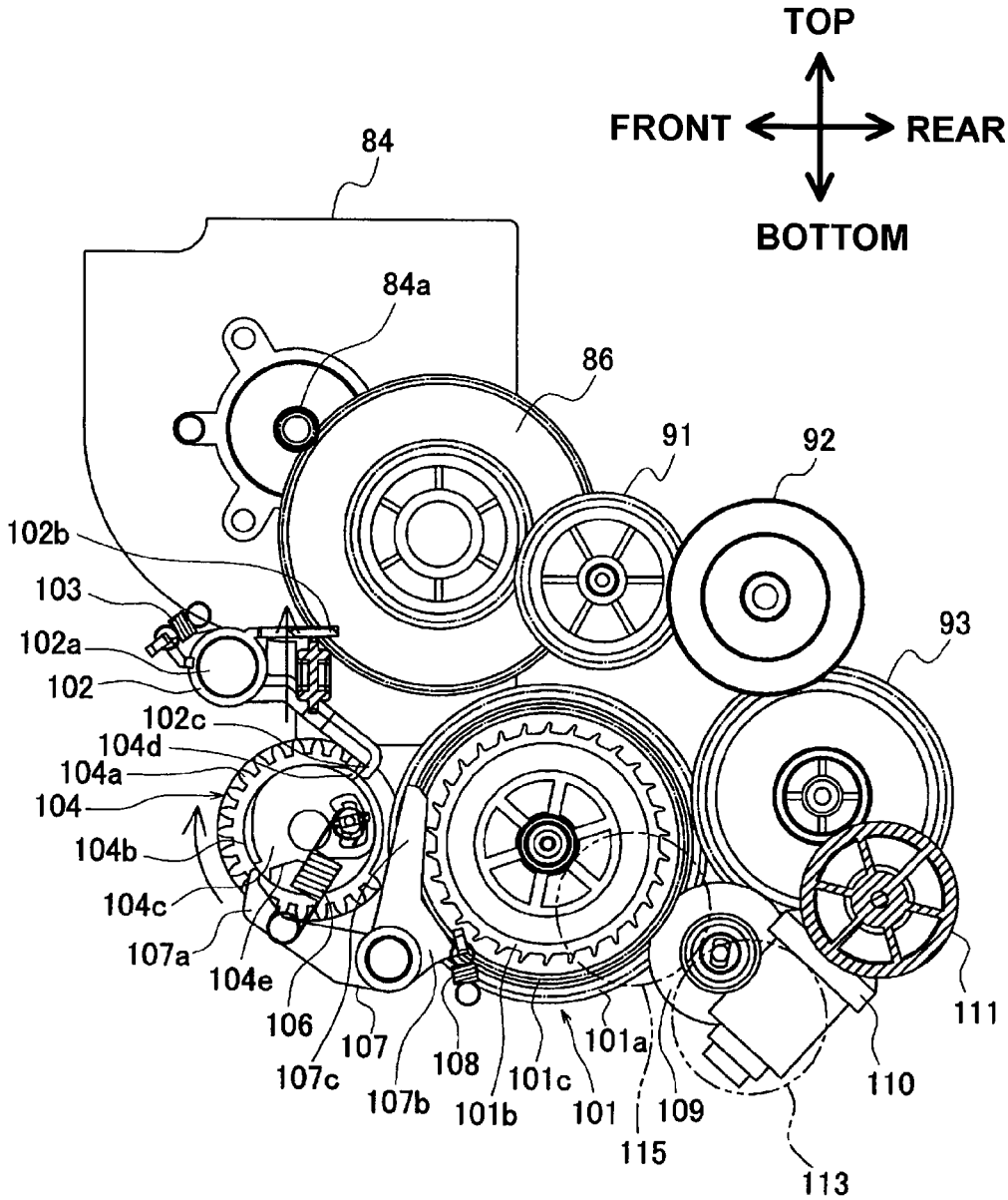
FIG. 6 is a cross sectional view of the pressing plate lifting mechanism.

As shown in FIG. 5, the left end 71*c* of the lift arm 71 is provided with a second hook 102 pivoting on a shaft 102*a* in accordance with vertical movement of the left end 71*c*. The second hook 102 includes a contact portion 102*b* that contacts an upper end of the left end 71*c*. The contact portion 102*b* is urged by the extension coil spring 103, so that it can be brought into contact with the upper end of the left end 71*c*, and moves in accordance with the vertical movement of the left end 71*c*. The second hook 102 includes a catch portion 102*c* that is configured to engage with a protrusion 104*d* of a switching gear 104 with the left end 71*c* of the lift arm 71 at the down position and disengage from the protrusion 104*d* with the left end 71*c* at the up position (FIG. 6).

As shown in FIG. 5, the switching gear 104 includes an external gear 104*a* with a partially non-tooth portion on an outer periphery, a stopper portion 104*b* disposed adjacent the right side, and a cam portion 104*c* disposed adjacent the right side. The stopper portion 104*b* includes a protrusion 104*d* on an outer cylindrical surface of the stopper portion 104*b*. The cam portion 104*c* includes a recessed portion 104*e* on an outer cylindrical surface of the cam portion 104*c*. In the switching gear 104 configured in this manner, the external gear 104*a* is configured to engage with an outer periphery of the ring gear 101*a* of the clutch gear 101 and to be urged by an extension coil spring 106 at a position shifted from a rotation axis of the switching gear 104.

A third hook 107 is disposed at the front of a sun gear 101*b* of the clutch gear 101. The third hook 107 has a front arm 107*a*, a rear arm 107*b*, and an upper arm 107*c*. The front arm 107*a* is disposed so that a tip thereof faces a cam surface of the cam portion 104*a* of the switching gear 104. The upper arm 107*c* is disposed so that its end faces an outer periphery of the sun gear 101*b*. The rear arm 107*b* is pulled rearward by an extension coil spring 108, and thus the third hook 107 is urged clockwise in FIG. 5.

With this configuration, the pressing plate lifting mechanism 100 allows the pressing plate 9 to lift as the number of sheets in the stack of sheets 4 decreases. When there are many sheets 4, the pickup roller 11 is located at a high position, the left end 71*c* of the lift arm 71 is positioned at the down position, and the catch portion 102*c* of the second hook 102 engages with the protrusion 104*d* of the switching gear 104 as shown in FIG. 5. In this state, the front arm 107*a* of the third arm 107 disengages from the recessed portion 104*e* of the cam portion 104*c*, and thus the upper arm 107*c* disengages from the sun gear 101*b* of the clutch gear 101. Thus, the sun gear 101*b* can rotate freely, the driving force transmitted from the idle gear 93 to the ring gear 101*a* is not outputted as motive power from a carrier 101*c*, and the sun gear 101*b* is idle.

When the pickup roller 11 moves downward as the sheets 4 are used, the right end of the lift arm 71 moves down by the action of the extension coil spring 72, and the left end 71*c* moves up. Thus, the catch portion 102*c* disengages from the protrusion 104*d*, as shown in FIG. 6. By the disengagement, the external gear 104*a* engages with the ring gear 101*a* by the urging force of the extension coil spring 106, and the switching gear 104 rotates clockwise in FIG. 6.

Figure 7:
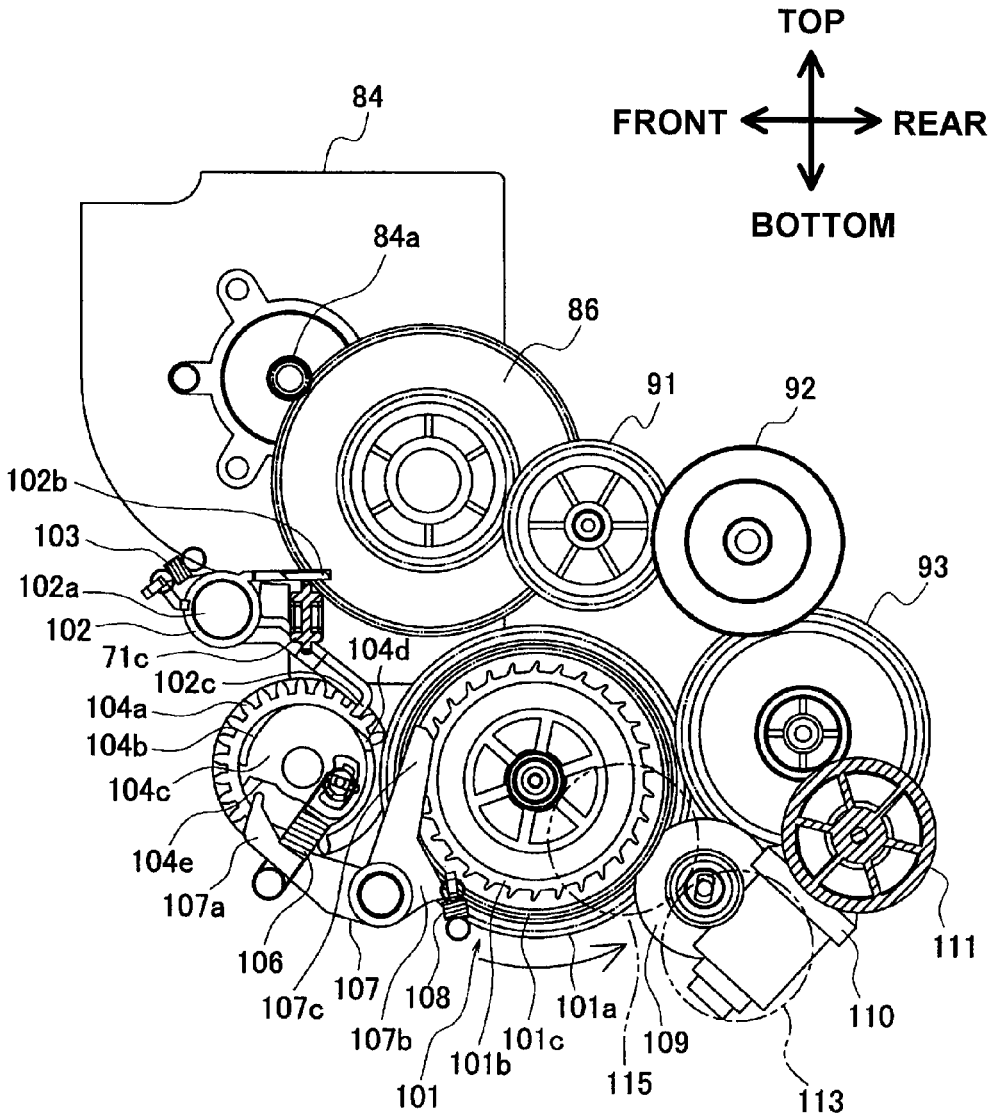
FIG. 7 is a cross sectional view of the pressing plate lifting mechanism.

As shown in FIG. 7, the tip of front arm 107*a* of the third hook 107 enters the recessed portion 104*e* of the cam portion 104, the third hook 107 moves clockwise in FIG. 7 and the upper arm 107*c* engages with the sun gear 101*b*. Then, the driving force transmitted from the idle gear 93 to the ring gear 101*a* is outputted as counterclockwise rotation from the carrier 101*c*.

Figure 8:
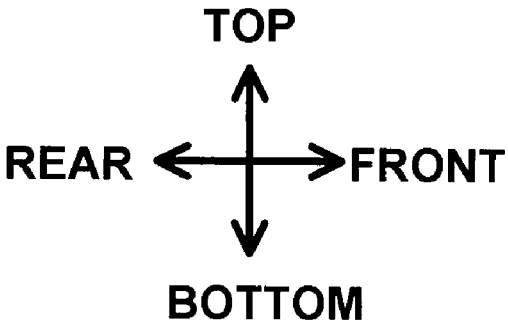
FIG. 8 is a left side view of a lift gear and a lift plate of the pressing plate lifting mechanism.
Figure 8:
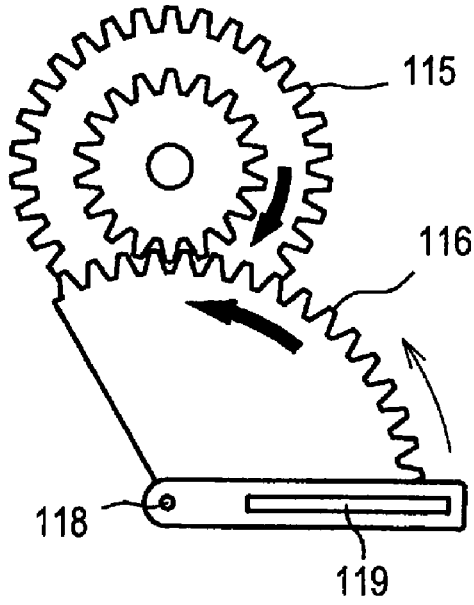

The driving force outputted from the carrier 101*c* is transmitted to a worm gear 109, a first bevel gear 110, and a second bevel gear 111 in this order, and further transmitted to an idle gear 113 disposed at the right of the worm gear 109, and a speed-reduction gear 115. As shown in FIG. 8, a small diameter part of the speed reduction gear 115 engages with a fan-shaped lift gear 116, and the lift gear 116 rotates on a shaft 118 integrally along with a lift plate 119. An end of the lift plate 119 contacts a lower surface of the pressing plate 9. The pressing plate 9 can be moved upward by the driving force outputted from the carrier 101*c*.

When the ring gear 101*a* further rotates, the switching gear 104 rotates to disengage the tip of the front arm 107*a* from the recessed portion 104*e*, and the carrier 101*c* stops rotating. When the ring gear 101*a* faces the non-tooth portion of the external gear 104*a*, the switching gear 104 returns to the position shown in FIG. 5 by the urging force of the extension coil spring 106. Normally, at this point, the pressing plate 9 is fully raised and the left end 71*c* of the lift arm 71 moves down as shown in FIG. 5, so that the catch portion 102*c* engages with the protrusion 104*d*.

In the above image forming apparatus 1, when the motor 84 rotates in the normal direction, the registration rollers 16, 17 are driven, the cleaning roller 41 rotates in the predetermined direction, and the driving force is transmitted also to the pressing plate lifting mechanism 100. When the motor 84 rotates in the reverse direction, the registration rollers 16, 17 are not driven, but the cleaning roller 41 rotates in the predetermined direction and the driving force is transmitted also to the pressing plate lifting mechanism 100. Thus, as compared with a case in which stopping of the registration rollers 16, 17 is carried out only by supplying power to the solenoid 83, the necessity to use a large-sized solenoid that can endure a long-duration power supply as the solenoid 83 is lowered, and thus the manufacturing cost of the image forming apparatus 1 may be reduced. Further, even when the motor 84 rotates in the reverse direction, the driving force is transmitted to the pressing plate lifting mechanism 100. Thus, the pressing plate 9 may be lifted during a warm-up on startup, so that sheet supply may be smoothly performed at an early time.

Even when the motor 84 rotates in the normal direction, the registration rollers 16, 17 can be stopped as appropriate by supplying power to the solenoid 83. Thus, the registration rollers 16, 17 can be controlled precisely. For example, when a sheet 4 is supplied from the manual feed tray 18, the following control may be carried out. The image forming apparatus 1 includes a sensor (not shown) for monitoring that a sheet 4 is inserted from the manual feed tray 18. When the sensor detects the insertion of a sheet 4, the motor 84 starts to rotate in the normal direction, the leading end of the sheet 4 is sandwiched between the registration rollers 16, 17, and then the solenoid 83 is supplied with current to stop the registration rollers 16, 17. The supply of current to the solenoid 83 is stopped after the rotational speed of the motor 84 rises to a specified value, and conveying of the sheet 4 is restarted. Alternatively, when a sheet 4 is supplied from the sheet supply tray 7, the following control may be carried out: the leading end of the sheet 4 may be brought into contact with the nip between the registration rollers 16, 17 to correct skewing, and the registration rollers 16, 17 may be temporarily stopped. When such a control is carried out while the motor 84 rotates in the reverse direction, there is no need to supply current to the solenoid 83 in order to stop the registration rollers 16, 17. Thus, in this illustrative embodiment, a relatively small solenoid may be used for the solenoid 83.

In the first, second and third gear mechanisms, a one way clutch may be used to switch between transmission and non-transmission of a driving force in accordance with the rotation direction of the motor 84. However, when the pendulum gears 89, 92 are used to switch between transmission and non-transmission a driving force and the first and second gear mechanisms share a gear train (made up of the speed-reduction gear 86, the idle gear 91, and the pendulum gear 92) as shown in the above illustrative embodiment, the structure of the gear mechanisms can be further simplified.

If the above precise control is not carried out for the operation of the registration rollers 16, 17, the clutch gear 81 and the solenoid 83 may be omitted. Even in this case, the operation to drive all of the registration rollers 16, 17, the cleaning roller 41, and the pressing plate lifting mechanism 100, and the operation to drive the cleaning roller 41 and the pressing plate lifting mechanism 100 with the registration rollers 16, 17 stopped can be selectively performed. In addition, during automatic registration, the cleaning roller 41 can be driven with the registration rollers 16, 17 stopped by rotating the motor 84 in the reverse direction. Thus, if a sheet 4 is wrongly inserted into the manual feed tray 18, for example, the registration rollers 16, 17 can be prevented from conveying the sheet 4.

As a method to prevent such a misfeed, while the motor 84 rotates in the normal direction, current may be continuously applied to the solenoid 83. However, in this illustrative embodiment, there is no need to continue to apply current to the solenoid 83 in order to stop the registration rollers 16, 17. With this example, a relatively small solenoid can be used for the solenoid 83.

The endless belt of the invention is not limited to a transfer belt, e.g. the conveyor belt 23. The endless belt may be an intermediate transfer belt or photosensitive belt.

This illustrative embodiment shows, but is not limited to, an electrophotographic image forming apparatus. It will be appreciated that this illustrative embodiment also applies to other types of image forming apparatuses, an inkjet type image forming apparatus, inkjet printer having an endless belt conveying a recording sheet while functioning as a platen as well.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an endless belt configured to be rotated;

an image forming device configured to form an image on a recording medium which is fed on the endless belt;

a cleaning roller configured to be rotated in a predetermined direction and to clean the endless belt;

a pair of registration rollers configured to be rotated in a recording medium feeding direction and to feed a recording medium toward the image forming device;

a motor configured to rotate in a first direction and a second direction opposite from the first direction and generate a driving force;

a first gear mechanism configured to transmit the driving force of the motor to the cleaning roller and rotate the cleaning roller in the predetermined direction upon rotation of the motor in the first direction, the first gear mechanism being configured not to transmit the driving force of the motor to the cleaning roller upon rotation of the motor in the second direction;

a second gear mechanism configured to transmit the driving force of the motor to the cleaning roller and rotate the cleaning roller in the predetermined direction upon rotation of the motor in the second direction, the second gear mechanism being configured not to transmit the driving force of the motor to the cleaning roller upon rotation of the motor in the first direction; and a third gear mechanism configured to transmit the driving force of the motor to the registration rollers and rotate the registration rollers in the recording medium feeding direction upon rotation of the motor in the first direction, the third gear mechanism being configured not to transmit the driving force of the motor to the registration rollers upon rotation of the motor in the second direction.

2. The image forming apparatus according to claim 1, further comprising:

a manual feed tray configured to load a recording medium inserted by a user, wherein the recording medium on the manual feed tray first contacts the registration rollers when being fed toward the image forming device.

3. The image forming apparatus according to claim 1, wherein the third gear mechanism includes a pendulum gear, the pendulum gear moves to a first position where the driving force is transmitted to the registration rollers upon rotation of the motor in the first direction, and the pendulum gear moves to a second position where the driving force is not transmitted to the registration rollers upon rotation of the motor in the second direction.

4. The image forming apparatus according to claim 1, further comprising:

a solenoid; and a clutch mechanism configured to switch between transmission and non-transmission of the driving force according to a state of the solenoid, wherein the third gear mechanism is configured to transmit the driving force to the registration rollers via the clutch mechanism.

5. The image forming apparatus according to claim 1, wherein the first gear mechanism includes a pendulum gear, the pendulum gear moves to a first position where the driving force is transmitted to the cleaning roller upon rotation of the motor in the first direction, and the pendulum gear moves to a second position where the driving force is not transmitted to the cleaning roller upon rotation of the motor in the second direction.

6. The image forming apparatus according to claim 5, wherein the second gear mechanism includes a pendulum gear, the pendulum gear moves to a third position where the driving force is not transmitted to the cleaning roller upon rotation of the motor in the first direction, and the pendulum gear moves to a fourth position where the driving force is transmitted to the cleaning roller upon rotation of the motor in the second direction.

7. The image forming apparatus according to claim 1, wherein the first gear mechanism and the second gear mechanism include a common gear train, the common gear train includes a pendulum gear, the pendulum gear moves to a first position where the pendulum gear is included in the first gear mechanism and engages with a gear not included in the second gear mechanism upon rotation of the motor in the first direction, and the pendulum gear moves to a second position where the pendulum gear is included in the second gear mechanism and engages with a gear not included in the first gear mechanism upon rotation of the motor in the second direction.

8. The image forming apparatus according to claim 1, further comprising:

a support plate configured to receive and support a recording medium or stack of recording media;

a supply roller configured to supply the topmost recording medium on the support plate to the registration rollers;

a moving mechanism configure to move the support plate toward the supply roller in response to a reduction in the number of recording media supported on the support plate; and a gear configured to be rotated in connection with the cleaning roller and apply the driving force to the mechanism.

9. An image forming apparatus comprising:

an endless belt configured to be rotated;

image forming means for forming an image on a recording medium that is fed on the endless belt;

cleaning means for being rotated in a predetermined direction and for cleaning the endless belt;

registration means for being rotated in a medium feeding direction and for feeding a recording medium toward the image forming means;

a motor for rotating in a first direction and a second direction opposite from the first direction and generating a driving force;

first gear means for transmitting the driving force of the motor to the cleaning means and rotating the cleaning means in the predetermined direction upon rotation of the motor in the first direction, the first gear means for not transmitting the driving force of the motor to the cleaning means upon rotation of the motor in the second direction;

second gear means for transmitting the driving force of the motor to the cleaning means and rotating the cleaning means in the predetermined direction upon rotation of the motor in the second direction, the second gear means for not transmitting the driving force of the motor to the cleaning means upon rotation of the motor in the first direction; and third gear means for transmitting the driving force of the motor to the registration means and rotating the registration means in the medium feeding direction upon rotation of the motor in the first direction, the third gear means for not transmitting the driving force of the motor to the registration means upon rotation of the motor in the second direction.

10. The image forming apparatus according to claim 9, further comprising:

support means for receiving and supporting a recording medium or stack of recording media;

supply means for supplying the recording medium to the registration means;

moving means for moving the support means toward the supply means in response to a reduction in the number of recording media supported by the support means; and applying means for being rotated in connection with the cleaning means and applying the driving force of the motor to the moving means.

* * * * *